US010618699B2

(12) United States Patent
Reid

(10) Patent No.: US 10,618,699 B2
(45) Date of Patent: Apr. 14, 2020

(54) STACKABLE MOLDED CAP

(71) Applicant: RIEKE CORPORATION, Auburn, CA (US)

(72) Inventor: Grahame M. Reid, Auburn, IN (US)

(73) Assignee: RIEKE LLC, Auburn, IN (US)

( * ) Notice: Subject to any disclaimer, the term of this patent is extended or adjusted under 35 U.S.C. 154(b) by 0 days.

(21) Appl. No.: 16/205,405

(22) Filed: Nov. 30, 2018

(65) Prior Publication Data

US 2019/0112108 A1 Apr. 18, 2019

Related U.S. Application Data

(63) Continuation of application No. 16/100,870, filed on Aug. 10, 2018, which is a continuation of application No. 10/985,562, filed on Nov. 10, 2004, now Pat. No. 10,071,835.

(51) Int. Cl.
*B65D 41/04* (2006.01)

(52) U.S. Cl.
CPC ..... *B65D 41/04* (2013.01)

(58) Field of Classification Search
CPC ..... B65D 39/00; B65D 41/00; B65D 41/005; B65D 41/04; B65D 1/023; B65D 5/118; B65D 1/0246; B65D 1/0223; B65D 41/0428; B65D 41/045; B65D 41/3442
USPC ..... 215/240, 356
See application file for complete search history.

(56) References Cited

U.S. PATENT DOCUMENTS

| | | | | |
|---|---|---|---|---|
| 2,117,296 | A | 9/1936 | Cahoon | |
| 2,647,652 | A | 8/1947 | Sanford | |
| 2,934,232 | A | 7/1959 | Pesch et al. | |
| 3,438,530 | A | 4/1969 | Wallace | |
| 3,447,714 | A | 6/1969 | Elliot | |
| 3,480,177 | A | 11/1969 | Elliot | |
| 3,648,874 | A | 3/1972 | Moller | |
| 4,066,180 | A | 1/1978 | Sanchez | |
| 4,202,456 | A | 5/1980 | Silber | |
| 4,322,010 | A | 3/1982 | Curry | |
| 4,347,943 | A | 9/1982 | Hackwell et al. | |
| 4,360,114 | A | 11/1982 | Owens | |
| 4,494,668 | A | 1/1985 | Lottick | |
| 4,723,685 | A | 2/1988 | Fillmore et al. | |
| 4,798,301 | A * | 1/1989 | Bullock | B65D 41/485 215/256 |
| 5,788,101 | A | 8/1998 | King | |
| 5,971,183 | A | 10/1999 | Bartsch | |
| D427,070 | S | 6/2000 | Brozell | |
| 6,371,317 | B1 | 4/2002 | Krueger | |

(Continued)

FOREIGN PATENT DOCUMENTS

| | | |
|---|---|---|
| EP | 0119055 | 9/1987 |
| JP | 09315452 | 12/1997 |

*Primary Examiner* — Ernesto A Grano
(74) *Attorney, Agent, or Firm* — McDonald Hopkins LLC

(57) ABSTRACT

A blending system is shown and described herein. A blending system may include a base An injection molded plastic closure, stackable with similar closures in a known manner to prevent warping during cooling and to increase box storage capacity, is formed with a lead-in taper at the bottom of the closure skirt, maintaining and enhancing the stacking function while greatly reducing and nearly eliminating problems of cross-threading when the closure is screwed onto a container by machinery during a capping operation.

20 Claims, 4 Drawing Sheets

(56) References Cited

U.S. PATENT DOCUMENTS

| | | | | |
|---|---|---|---|---|
| 6,439,412 | B2 | 8/2002 | Luch | |
| 6,454,118 | B1 | 9/2002 | D'Amato | |
| D481,314 | S | 10/2003 | Noonan | |
| 6,685,049 | B1 | 2/2004 | Paladino | |
| 6,913,157 | B2 * | 7/2005 | Oh | B65D 41/04 215/329 |
| 2004/0040928 | A1 | 3/2004 | Noonan | |
| 2004/0045926 | A1 | 3/2004 | Williamson | |
| 2013/0090033 | A1 * | 4/2013 | Vollers | A63H 33/086 446/71 |

* cited by examiner

STACKABLE MOLDED CAP

CROSS-REFERENCE TO RELATED APPLICATION

This application is a continuation of U.S. patent application Ser. No. 16/100,870 filed Aug. 10, 2018, and entitled "STACKABLE MOLDED CAP," which is a continuation of U.S. patent application Ser. No. 10/985,562, filed Nov. 10, 2004, and entitled "STACKABLE MOLDED CAP," the entireties of which are incorporated herein by reference.

BACKGROUND OF THE INVENTION

Blending systems are often used to blend and process foodstuffs. In recent years, personal blending systems have been developed with blending This invention concerns injection molded closure caps and particularly such closure caps which address the problem of warping during post-molding curing.

In the interests of economy, injection molded plastic caps have been reduced in thickness and weight. A 110 mm cap (110-400), for example, can have a weight of less than about 18 grams, including the cap seal. One effect is that the top disk or panel becomes even more prone to warping during cooling and curing of the cap after molding, a process that can take about 24 hours. Warping can be induced by storing the just-molded closures in a container in random arrangement. This puts warping forces against the molded closures during curing, particularly those near the bottom of a bin or case. As a result, problems are encountered during automated assembly of the threaded closure cap onto a container.

A solution to this problem was devised by the assignee of the present invention, and has been used for several years. This solution has been to stack the caps coaxially, forming stacks or "logs" of caps by spinning each cap as it emerges from the mold, allowing them to "walk" along rotating rods to settle into a coaxially stacked log. In this way, all of the closures in a 5 stack or log of caps are maintained in the proper shape during the curing period. Caps can be made lighter and thinner as a result of this log stacking process. Closure caps produced for such handling and stacking have included a nesting recess in the skirt of the closure, enabling the top of one cap to nest within the bottom edge of the skirt of a succeeding cap, resting on a ledge in the recess. Another benefit of stacking is compact storage, allowing more caps to a shipping case.

Although the stacking feature on the described caps, which included large 110 mm caps, worked well, the closures sometimes 15 tended to cross-thread when screwed onto a container neck, especially in an assembly line capping operation in which containers were filled and closed. This caused an unacceptable rejection rate in the filling/assembly process. The configuration of the cylindrical recess for nesting the top of the succeeding cap tended to allow the cap to catch on the bottle finish and to become canted and this led to occasional crossthreading. This problem is related to the "S" dimension, which is defined as the dimension from the bottom of the cap's skirt up to the bottom of the thread start. In the case of the subject 25 cap with the cross-threading problems, there were in essence two "S" dimensions: the distance from the skirt bottom up to the rim or ledge; and the distance from the ledge to the thread start. This simply provided too great an opportunity for canting and cross-threading, since the ledge at one side could catch on the bottle finish during cap assembly.

SUMMARY OF THE INVENTION

This invention provides a solution to the above-described problem by eliminating the cap-nesting ledge on the interior of the skirt. Instead, the region below the thread start leads in with a taper, i.e. an annular section of a cone. This cone section or taper begins just a slight distance above the bottom of the skirt, at the point of largest diameter, and terminates at a smaller-diameter upper end which is essentially at the bottom of the thread start.

The external shoulder of the cap has a complementary bevel, configured to nest against the taper of an adjacent cap when the caps are stacked.

The injection molded lightweight closure cap of the invention is capable of being pushed axially down over the container thread or threads for an initial portion of the thread depth. In a capping operation, the cap is pushed down onto the container finish with a flat, horizontal "tongue". During this downward movement of the cap, essentially nothing is present to cause the cap to catch and cant, but even if this does occur to some extent; the taper may then contact the container finish, whereupon the taper slides along the container finish and tends to straighten the cap to the flat position for proper threading. If sufficient force is applied to the tongue, an initial portion of the thread can be caused to jump over the corresponding container thread until a wide band of cap thread rests on container thread, the two threads having the same helix angle and thus causing the cap to assume the flat horizontal position for proper threading. The ability to "jump" an initial portion of the thread is helped by the thinner wall of the cap, which is enabled because of the log stacking.

The invention can be applied to injection molded caps of virtually any size including 110 mm, 120 mm (or even larger), as well as smaller caps; the warping problem, and thus the need for stacking, is greater with the larger caps, but any caps that have the stacking recess are benefited.

It is among the objects of this invention to improve the geometry of stackable injection molded plastic closure caps, especially those of relatively large diameter but also including smaller-diameter caps, by greatly reducing or eliminating the tendency of a stacking closure to cross-thread during an automatic capping operation. These and other objects, advantages and features of the invention will be apparent from the following description of a preferred embodiment, considered along with the drawings.

DESCRIPTION OF PREFERRED EMBODIMENTS

Figure 1:
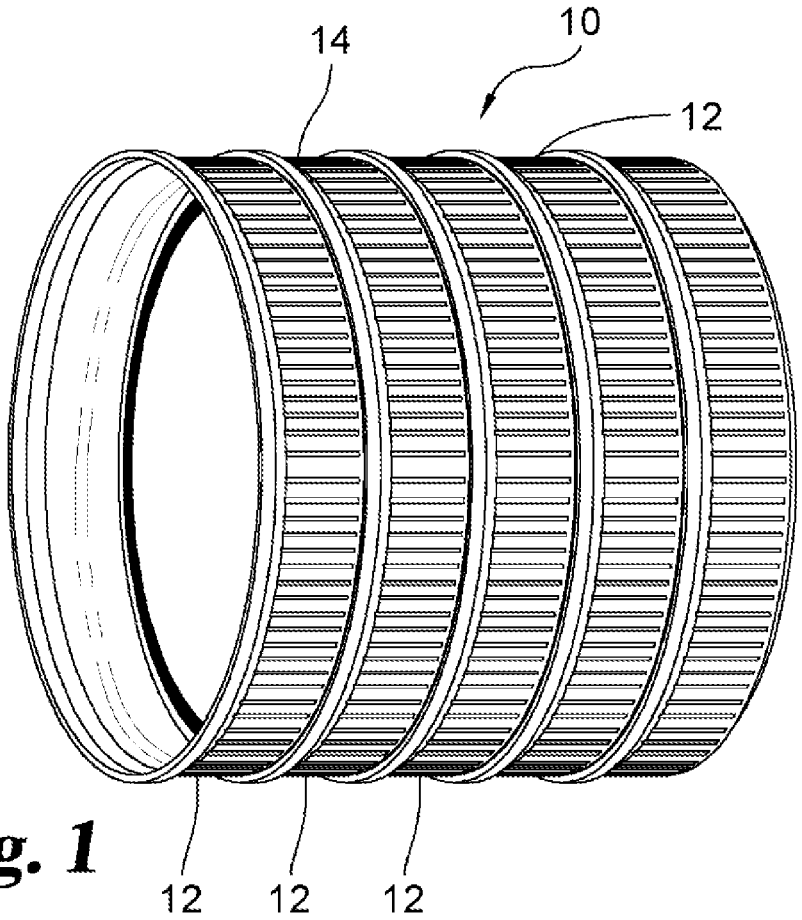
FIG. 1 is a perspective view showing a series of injection molded plastic caps stacked together into a "log" following molding.

In the drawings, FIG. 1 shows a "log" or stack 10 of injection molded closure caps 12, a stacked configuration which is useful in handling and storing the caps during the curing period, after molding, to prevent warp. This is especially true with thin, lightweight injection molded caps and particularly with caps of relatively large diameter, such as 110 mm and 120 mm but also for caps of smaller diameters. The caps 12 are nested together in an overlapping position in which the bottom edge of the skirt 14 of one cap overlaps the shoulder and upper edge of the skirt of the next cap.

Figure 2:
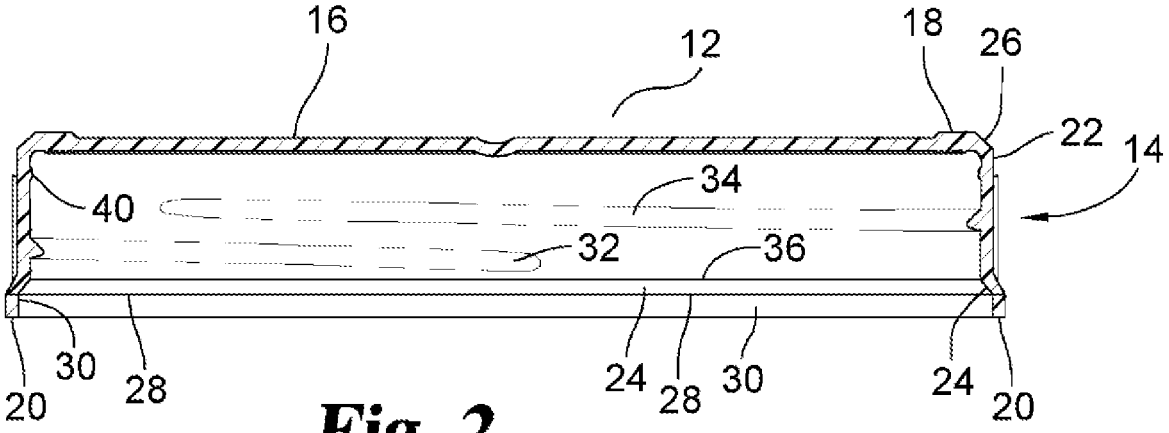
FIG. 2 is a cross-sectional side view showing an embodiment of the cap of the invention.
Figure 3:
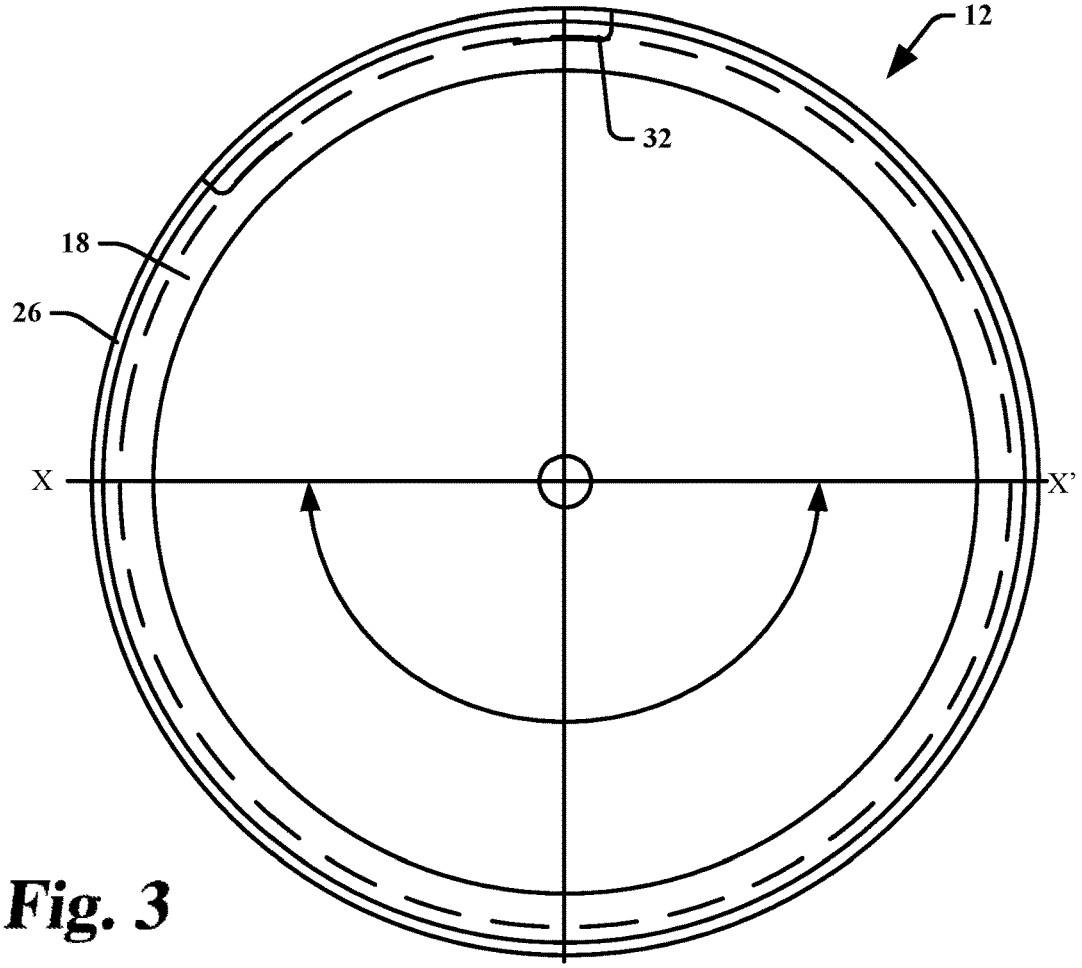
FIG. 3 is a top plan view of the cap of FIG. 2.
Figure 4:
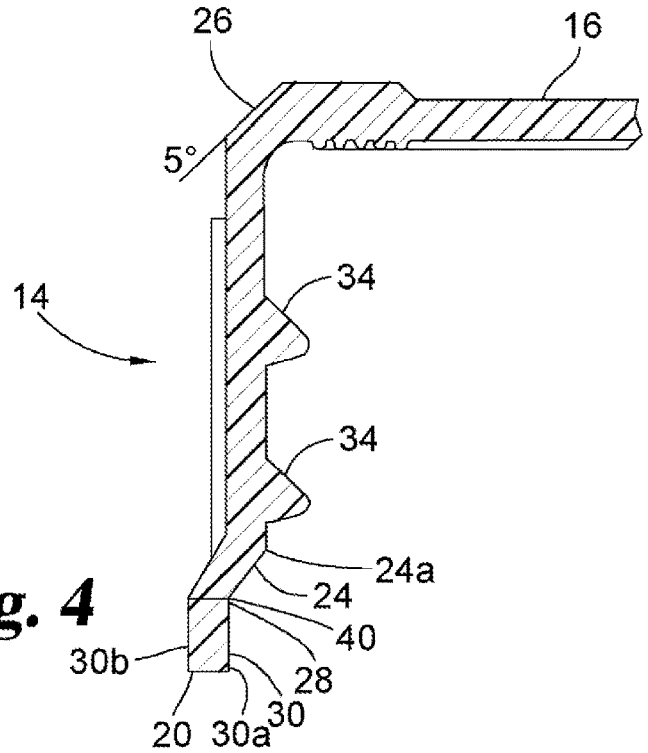
FIG. 4 is a fractional cross-sectional side view showing some details of the cap of FIGS. 2 and 3.

FIG. 2 shows a cap of the invention in a cross-sectional elevation view. FIG. 3 shows the cap 12 in top plan view. As indicated, the circular, substantially flat top panel 16 of the closure cap has a shoulder 18 of somewhat increased thickness, the annular shoulder 18 being connected to the skirt 14. The skirt has a bottom edge 20 that has a diameter larger than that of the top of the skirt, for stacking the cap 12 to overlap with the shoulder of an adjacent cap in a "log" 10 such as shown in FIG. 1. The internal diameter of the skirt at the bottom edge 20 is slightly larger (e.g. about 0.01 inch larger) than the external diameter of the skirt at the shoulder, at the location 22 in FIG. 2.

Figure 5:
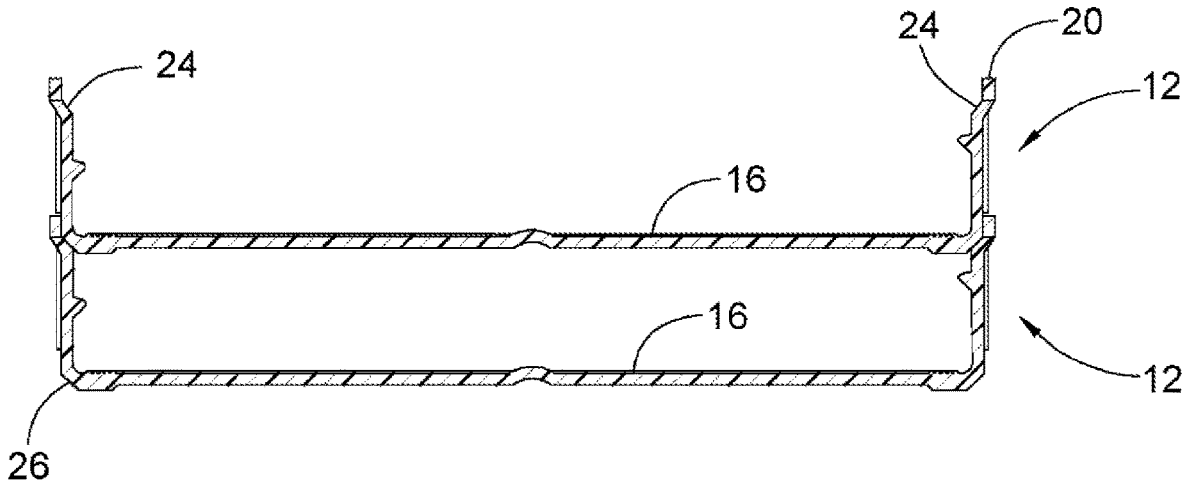
FIG. 5 is a sectional elevation view showing several of the closure caps stacked together.
Figure 6:
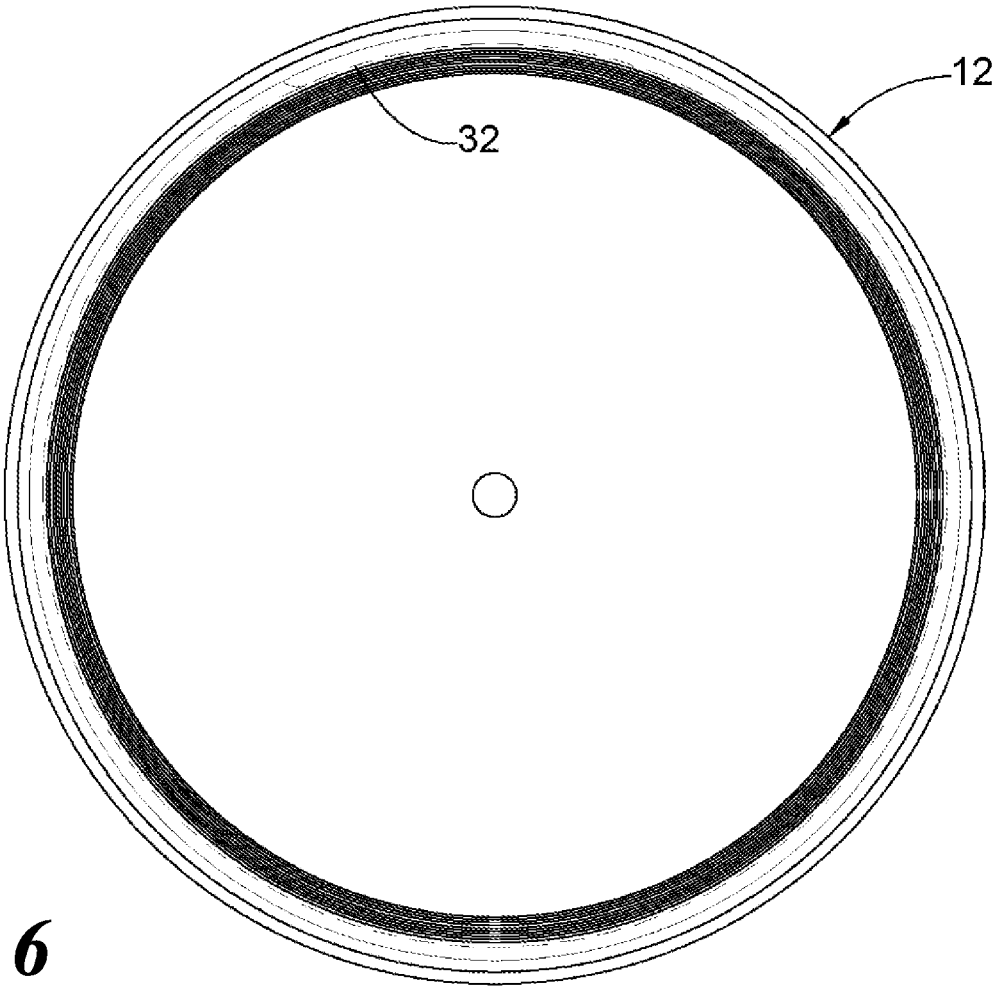
FIG. 6 is a bottom view of the cap of FIG. 2.

As shown in the figures, the configuration in the lower portion of the skirt 14 includes a taper 24, i.e. essentially a section of a cone wherein the diameter at the interior of the skirt is reduced over a short vertical distance, such as a distance of about 0.05 to 0.1 inch, on a 110 mm cap. The distance may be about 0.05 to 0.06 inch. This taper is at an oblique angle which may be about 45°, and a bevel 26 of similar angle is provided at the exterior shoulder of the cap as shown, so that this shoulder 26 will nest with and lie against the taper 24 when two caps are stacked together, as shown in FIG. 5.

Although the bottom edge 28 of the taper 24 could theoretically be precisely at the bottom edge 20 of the skirt, in practice this is difficult to injection mold, and thus a short cylindrical portion 30 preferably is included. This cylindrical section may be about 0.05 to about 0.1 inch, and may be about 0.06 inch.

FIG. 2 shows the "S" dimension, i.e. the distance from the bottom edge 20 of the skirt to the bottom of the thread start 32. This "S" distance is actually made up of essentially two distances: the distance from the bottom skirt edge 20 to the bottom 28 of the taper; and the distance from the taper up to the bottom of the thread start 32. In this case the first "S" distance is somewhat vague and undefined due to the taper, there being no firm ledge presented to engage against a bottle finish or any other structure. The thread 34 is a single start thread, preferably traversing a minimum angle, such as about 405° (about 1⅛ turns), and follows an industry standard. The closure can include multiple threads if desired, depending on the standard to be followed. The distance from the top edge 36 of the taper 24 up to the bottom of the thread start 32 may be about 0.05 to 0.06 inch or even less if desired.

As one example of dimensions for a 110 mm plastic closure cap, the outer diameter of the cap at the shoulder (just below the bevel 26) is about 4.43 inches, while the inside diameter at the bottom of the skirt 20 is about 4.45 inches. The height of the taper 24, and also of the external shoulder bevel 26, can be about 0.05 to 0.06 inch. The overall height of the closure cap may be about 0.65 inch, while the internal height of the skirt up to the bottom of the shoulder area 18 may be about 0.59 inch. The maximum outside diameter of the cap, at the bottom skirt edge 20, may be about 4.55 inches. Thickness may be about 0.045 inch in the top panel (center) and about 0.044 inch in the skirt wall. The "S" dimension from the bottom of the skirt up to the bottom of the thread start 32 may be about 0.165 inch. The skirt has a slight inward taper as it progresses upwardly, and this may be about 1°.

The closure cap 12 is designed to receive a seal (not shown) up against the underside of its circular top panel, and for this purpose a bead 40 (FIG. 2) extends through an arc of about 180° or more in an upper area of the skirt's interior. This bead, as is known in closure caps, is to retain a loosely assembled seal in the cap until the closure is screwed onto a container and then usually induction heated to secure the seal against the container finish.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

What is claimed is:

1. A molded plastic stackable cap comprising:

a top panel;

an annular shoulder generally circumventing the top panel and comprising an external perimeter that reduces in diameter over a first vertical distance;

an annular skirt extending from the annular shoulder and ending at a bottom edge, wherein the annular skirt comprises:

a side wall comprising an inner surface, the inner surface comprising at least one thread and a mating portion disposed below the at least one thread and above the bottom edge, wherein the mating portion comprises an internal perimeter that reduces in diameter over a second vertical distance, wherein the side wall is free of any ledge that engages against another structure when the molded plastic stackable cap is stacked, and wherein the external perimeter of the annular shoulder and the internal perimeter of the mating portion are shaped such that their diameters reduce at generally the same rate over the first vertical distance and second vertical distance, wherein the annular skirt comprises an inner diameter that is larger than an external diameter of the side wall proximal the annular shoulder such that the molded plastic stackable cap is configured to stack free of a press or friction fit arrangement.

2. The molded plastic stackable cap of claim 1, wherein a diameter of the top panel is selected from a range of distances at or between generally 63 mm or 120 mm.

3. The molded plastic stackable cap of claim 1, wherein a diameter of the top panel is larger than a height of the molded plastic stackable cap.

4. The molded plastic stackable cap of claim 1, wherein a ratio of a diameter of the top panel to a height of the molded plastic stackable cap is generally greater than 6 to 1.

5. The molded plastic stackable cap of claim 1, wherein a ratio of a diameter of the top panel to a height of the molded plastic stackable cap is generally greater than 6.5 to 1.

6. The molded plastic stackable cap of claim 1, wherein a thickness of the top panel is generally less than 1.15 mm.

7. The molded plastic stackable cap of claim 1, wherein a thickness of the annular skirt is generally less than 1.12 mm.

8. The molded plastic stackable cap of claim 1, wherein the inner surface of the side wall further comprises a bead disposed between the at least one thread and the top panel.

9. The molded plastic stackable cap of claim 1, wherein the at least one thread comprises a minimum angle of at least generally 400 degrees.

10. The molded plastic stackable cap of claim 1, wherein the side wall further comprises an outer surface that includes a portion having an external perimeter that reduces in diameter over a vertical distance.

11. A stackable cap assembly comprising:

at least two plastic stackable caps, wherein each of the stackable caps comprises:

a top panel surrounded by an annular shoulder, and an annular skirt extending from the annular shoulder to a bottom edge;

wherein the annular shoulder comprises an outer surface that reduces in diameter from the annular shoulder to the top panel;

wherein the annular skirt comprises an inner surface that comprises at least one thread and at least one inner mating surface having a reduced diameter from proximal the bottom edge to proximal the at least one thread;

wherein the annular shoulder of a first stackable cap of the at least two plastic stackable caps nests within an inner mating surface of a second stackable cap of the at least two plastic stackable caps without contacting a thread of the second stackable cap, and wherein the inner surfaces of the at least two stackable caps are free of ledges between the at least one thread and the bottom edge; and wherein the bottom edge of the second stackable cap comprises an inner diameter that is larger than an external diameter of a side wall of the first stackable cap proximal an annular shoulder such that the first stackable cap nests within the second annual cap.

12. The stackable cap assembly of claim 11, wherein a diameter of each of the stackable caps is greater than a height each of the stackable caps.

13. The stackable cap assembly of claim 11, wherein each of the stackable caps comprises injection molded plastic.

14. The stackable cap assembly of claim 11, wherein the outer surface of the annular shoulder is at least one of beveled or filleted.

15. The stackable cap assembly of claim 11, wherein the inner mating surface of each of the stackable caps terminates at the bottom edge of the annular skirt.

16. The stackable cap assembly of claim 11, wherein the top panels of each of the stackable caps are free from contacting each other when the stackable caps are operatively stacked.

17. The stackable cap assembly of claim 11, wherein the first stackable cap is inserted within the second stackable cap for a distance between about 0.1 inches to 0.2 inches.

18. A method of molding comprising:

injection molding caps to include:

a top panel;

an annular shoulder generally circumventing the top panel and comprising an external perimeter that reduces in diameter over a vertical distance;

an annular skirt extending from the annular shoulder to a bottom edge, wherein the annular skirt comprises a side wall comprising an inner surface, the inner surface comprising at least one thread and a generally frusto-conical portion disposed below the at least one thread and the bottom edge, and wherein the side wall is free of any ledge that engages against another structure when the molded plastic stackable cap is stacked; and stacking the caps such that an external perimeter of an annular shoulder of one cap nests within a generally frusto-conical portion of a second cap without contacting a thread of the second cap, wherein a bottom edge of the second cap comprises an inner diameter that is larger than an external diameter of a side wall of the first cap proximal an annular shoulder such that space is provided between the bottom edge of the second cap and the side wall of the first cap.

19. The method of claim 17, further comprising stacking the caps during a curing process.

20. The method of claim 17, further comprising stacking the caps during a shipping process.

* * * * *